United States Patent [19]

Scott

[11] 4,056,392

[45] Nov. 1, 1977

[54] ADDITIVE COLOR SILVER SALT TRANSFER FILM UNIT WITH LAYER OF CHITIN AND CUPRIC SALT

[75] Inventor: Kenneth G. Scott, Natick, Mass.

[73] Assignee: Polaroid Corporation, Cambridge, Mass.

[21] Appl. No.: 697,104

[22] Filed: June 17, 1976

[51] Int. Cl.[2] ..... G03C 7/00; G03C 5/54; G03C 1/48; G03C 1/84

[52] U.S. Cl. ..... 96/3; 96/25; 96/76 R; 96/29 R; 96/80; 96/84 R; 96/110

[58] Field of Search ..... 96/3, 29 R, 76 R, 80, 96/84 R, 25, 110

[56] References Cited

U.S. PATENT DOCUMENTS

| | | | |
|---|---|---|---|
| 3,003,875 | 10/1961 | Ryan | 96/29 R |
| 3,674,482 | 7/1972 | Hablerin | 96/3 |

*Primary Examiner*—David Klein
*Assistant Examiner*—Richard C. Schilling
*Attorney, Agent, or Firm*—Philip G. Kiely

[57] ABSTRACT

This invention is directed to an additive color diffusion transfer film unit which comprises, in order, an additive multicolor screen, a silver precipitating layer, a layer of chitin having a copper salt disposed therein, and a photosensitive silver halide layer.

23 Claims, 3 Drawing Figures

ADDITIVE COLOR SILVER SALT TRANSFER FILM UNIT WITH LAYER OF CHITIN AND CUPRIC SALT

BACKGROUND OF THE INVENTION

Procedures for preparing photographic images in silver by diffusion transfer principles are well known in the art. For the formation of the positive silver image a latent image contained in an exposed photosensitive silver halide emulsion is developed and almost concurrently therewith a soluble silver complex is obtained by reaction of a silver halide solvent with the unexposed and the undeveloped silver halide of said emulsion. Preferably, the photosensitive silver halide emulsion is developed with a processing composition in a viscous condition which is spread between the photosensitive element comprising the silver halide emulsion and a print receiving element comprising a suitable silver precipitating layer. The processing composition effects development of the latent image in the emulsion and substantially contemporaneous therewith forms a soluble silver complex, for example, a thiosulfate or thiocyanate complex, with undeveloped silver halide. This soluble silver complex is, at least in part, transported in the direction of the print receiving element and the silver ion thereof is largely reduced to silver metal and precipitated in the silver precipitating element to form a positive image thereon. Procedures of this type are disclosed, for example, in U.S. Pat. No. 2,543,181 issued to Edwin H. Land. See also Edwin H. Land; *One Step Photography;* Photographic Journal, Section A, pages 7-15, January, 1950.

Additive color reproduction may be obtained by exposing a photosensitive silver halide emulsion through an additive color screen having filter media or screen elements each of an individual additive color such as red, or green, or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography mention may be made of the U.S. Pat. Nos. 2,861,885, 2,726,154, 2,944,894, 3,536,488, 3,615,427, 3,615,428, 3,615,429, 3,615,426, and 3,894,871.

U.S. Pat. No. 3,364,482 discloses an additive color diffusion transfer film unit of the type described above which comprises, in order, a support, an additive color screen, silver precipitating nuclei in a processing composition permeable layer, a non-nucleating photoinsensitive layer, and a silver halide emulsion layer. The aforementioned non-nucleating photoinsensitive layer is preferably deacetylated chitin whose primary purpose is to provide a protective barrier over the nucleating layer which, subsequent to exposure and processing, contains the positive silver image, after the silver halide emulsion layer has been detached from the remainder of the film unit.

A novel and improved additive color diffusion transfer film unit has now been found.

BRIEF SUMMARY OF THE INVENTION

The present invention is directed to an additive color photographic diffusion transfer film unit which comprises, in order, a transparent support, an additive color screen, a copper/chitin layer comprising chitin containing a water-soluble salt of copper, and a photosensitive silver halide emulsion layer. It should be understood that wherever reference is made to a water-soluble salt of copper, the copper is present in the cupric valence state.

The term "chitin", as used herein, refers to deacetylated chitin, the hydrolysed polymeric form of chitin. It should also be understood that similar advantageous results can be obtained using chitin in its deacetylated monomeric form, 2-amino-2-deoxyglucose, as well as mixtures of the monomeric and polymeric form. The term chitin, therefore, is intended to include both the deacetylated monomeric and polymeric forms.

BRIEF DESCRIPTION OF THE INVENTION

FIG. 1 is a diagrammatic enlarged cross-sectional view illustrating a preferred film unit within the scope of the present invention;

FIG. 2 reproduces a characteristic curve of the red, green, and blue densities of the neutral column of an additive color transparency of the present invention;

FIG. 3 reproduces a characteristic curve of the red, green, and blue densities of the neutral column of the control additive color transparency.

DETAILED DESCRIPTION OF THE INVENTION

In the film unit of the present invention, by interposing the copper/chitin interlayer between the silver precipitating layer and silver halide emulsion layer, an increase in $D_{max}$ is achieved with substantially no adverse affect on $D_{min}$. It has been found, as will be shown in the examples set forth below, that the advantageous results indicated above are achieved by the combination of the water soluble copper salt and the chitin. For example, by employing each component alone, that is, a layer of chitin alone, or a layer of the water soluble copper salt with a different polymer, the film unit will not exhibit the enhanced density obtained with the combination. While not intending to be bound by theory, it is believed that the copper ion may be exerting an antifoggant effect on the adjacent silver halide emulsion layer, and the chitin, while it is permeable to the soluble silver complex, does not appreciably swell in the aqueous alkaline processing composition.

Assuming that the copper is functioning as an oxidizing agent, the advantageous results achieved by the present invention are unexpected in view of the fact that other oxidizing agents, such as cobalt acetate and potassium ferricyanide do not function in the same manner; i.e., do not provide the enhanced densities.

Alternatively, the copper/chitin layer may be acting as a catalyst for the reduction of complexed silver by the developer in the positive layer.

Substantially any water soluble salt of copper (II) may be employed in the present invention. Since it is the cupric ion which is believed to be the active moiety, the anion is not critical. However, care should be taken that an anion which would be detrimental to the photograhic process not be employed. In a preferred embodiment the water soluble salt employed in the present invention is copper acetate or copper gluconate.

The copper/chitin interlayer of the present invention provides particularly advantageous results with film units employing noble metal silver precipitating layers and, in a particularly preferred embodiment, the silver precipitating layers containing noble metals as described and claimed in application Ser. No. 649,201, filed Jan. 14, 1976.

The amount of copper and chitin employed in the interlayer is not critical and may vary over a relatively wide range. In a preferred embodiment the copper, as the cupric ion, may range from about 0.1 to 1 mgs/ft$^2$ and the chitin from about 1 to 10 mgs/ft$^2$. In a preferred embodiment about 0.6 mgs./ft.$^2$ copper and 7 mgs./ft.$^2$ chitin are employed.

Figure 1:
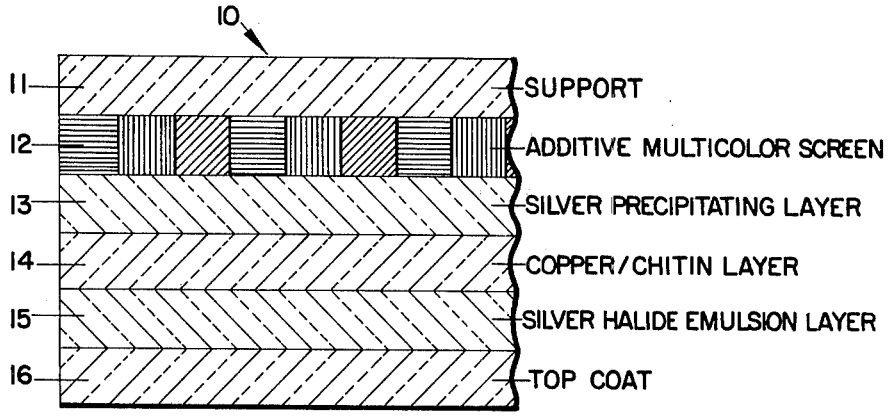

Turning now to the drawings, FIG. 1 is a diagrammatic enlarged cross-sectional view illustrating a preferred film unit within the scope of the present invention. Film unit 10 comprises a transparent support 11 carrying additive multicolor screen 12 composed of red, green, and blue filter elements, silver precipitating layer 13, a copper/chitin layer 14, a photosensitive silver halide emulsion layer 15 and a top coat 16 containing an antihalation system. Film units containing the herein described top coats are disclosed and claimed in copending application of Edwin H. Land Ser. No. 383,261, filed July 27, 1973.

The following non-limiting examples illustrate the novel film units of the present invention.

EXAMPLE 1

A film unit was prepared comprising a transparent polyester film base carrying on one surface an additive color screen of approximately 1000 lines each per inch of red, blue, and green filter screen elements in repetitive side-by-side relationship; a 4 micron thick protective overcoat layer comprising a layer of vinylidine chloride/acrylonitrile copolymer; a nucleating layer comprising palladium nuclei prepared according to the procedure in Example 8 of application Ser. No. 649,201, filed Jan. 14, 1976, at a coverage of 0.2 mgs/ft$^2$ Pd and 0.3 mgs/ft$^2$ gelatin; a copper/chitin layer, as described below; a panchromatically sensitized, hardened silver iodo-bromide emulsion having a grain size of about 0.7 to 0.9 microns, coated at a coverage of about 115 mgs/ft$^2$ of gelatin, about 85 to 100 mgs/ft$^2$ of silver, about 5 mgs/ft$^2$ of propylene glycol alginate, about 216 mgs/ft$^2$ of alkylphenoxypolyoxyethylene ethanol, about 50 mgs/ft$^2$ of carboxylated styrene/butadiene copolymer latex and about 0.65 mgs/ft$^2$of potassium chromium sulfate; and a top coat of the following composition and coverage:

| | mgs/ft$^2$ |
|---|---|
| Gelatin | 300 |
| Dow 620 (Carboxylated styrene/butadiene copolymer latex Dow Chemical Co., Midland, Michigan) | 175 |
| Propylene glycol alginate | 8.8 |
| Dioctyl ester of sodium sulfosuccinate | 1.2 |
| Benzimidazole-2-thiol gold $Au^{+1}$ complex | 5 (as gold) |
| Daxad-11 (polymerized sodium salts of alkyl naphthalene sulfonic acid) Manufactured by W. R. Grace & Co. Cambridge, MA. | 0.36 |
| Pyridinium bis-1,5 (1,3-diethyl-2-thiol-5-barbituric acid) pentamethine oxanol | 5.6 |
| 4-(2-chloro-4-dimethylamino benzaldehyde)-1-(p-phenyl carboxylic acid)-3-methyl pyrazolone-5 | 7 |

Film units prepared according to the above procedure were given a 16 mcs exposure through the additive color screen and were processed with mechanical lab rollers at a 1.4 mil gap disposing the processing composition set forth below between the top coat and a polyethylene terephthalate cover sheet. The film unit was held in the dark for 1 minute and then after separation of the cover sheet retaining the rest of the film unit together and air drying the neutral column was read to red, green and blue light in a automatically recording densitometer.

| Processing Composition | Weight % |
|---|---|
| Sodium hydroxide | 7.21 |
| Hydroxyethyl cellulose (sold by Hercules, Inc., Wilmington, Delaware under the tradename Natrasol 250 H) | 0.63 |
| Tetramethyl reductic acid | 7.48 |
| Sodium sulfite | 3.6 |
| 2-methylthiomethyl-4,6-dihydroxypyrimidine | 7.48 |
| N-benzyl picolinium bromide | 1.49 |
| Water to make 100% | |

Copper/Chitin Composition

To a solution comprising:
3300 g. distilled water
3.312 g. copper acetate monohydrate
was added a solution comprising:
279.41 g. distilled water
9.06 g. acetic acid
11.52 g. deacetylated chitin The thus-formed solution was coated after addition of 300 ml. of 0.1% alkylphenoxypolyoxyethylene ethanol surfactant over the receiving layer comprising Pd nuclei in the coverages indicated to form a copper/chitin interlayer between the receiving layer and the silver halide emulsion layer.

The acetic acid coverages in the following Examples is a calculated value and it should be understood that there may be some loss due to evaporation.

EXAMPLE 2

A film unit was prepared and processed as set forth in Example 1 with the following copper/chitin coverage.

| | mgs/ft$^2$ |
|---|---|
| Chitin | 7.4 |
| Copper Acetate Monohydrate | 2.15 (0.68 $Cu^{+2}$) |
| Acetic Acid | 5.8 |
| Alkylphenoxypolyoxyethylene ethanol surfactant sold under the trade name PE-120 by NOPCO Chemical Division of Diamond Shamrock Company | 0.195 |

The following densitometer readings were obtained:

| $D_{max}/D_{min}$ Red | Green | Blue |
|---|---|---|
| 3.44/0.46 | 3.17/0.44 | 3.00/0.45 |

EXAMPLE 3

No copper

A film unit was prepared and processed as in Example 2 except the copper acetate was omitted in order to ascertain the effect of the copper. The following densitometer readings were obtained.

| Red | $D_{max}/D_{min}$ Green | Blue |
|---|---|---|
| 2.10/0.46 | 2.03/0.44 | 1.90/0.43 |

Figure 3:
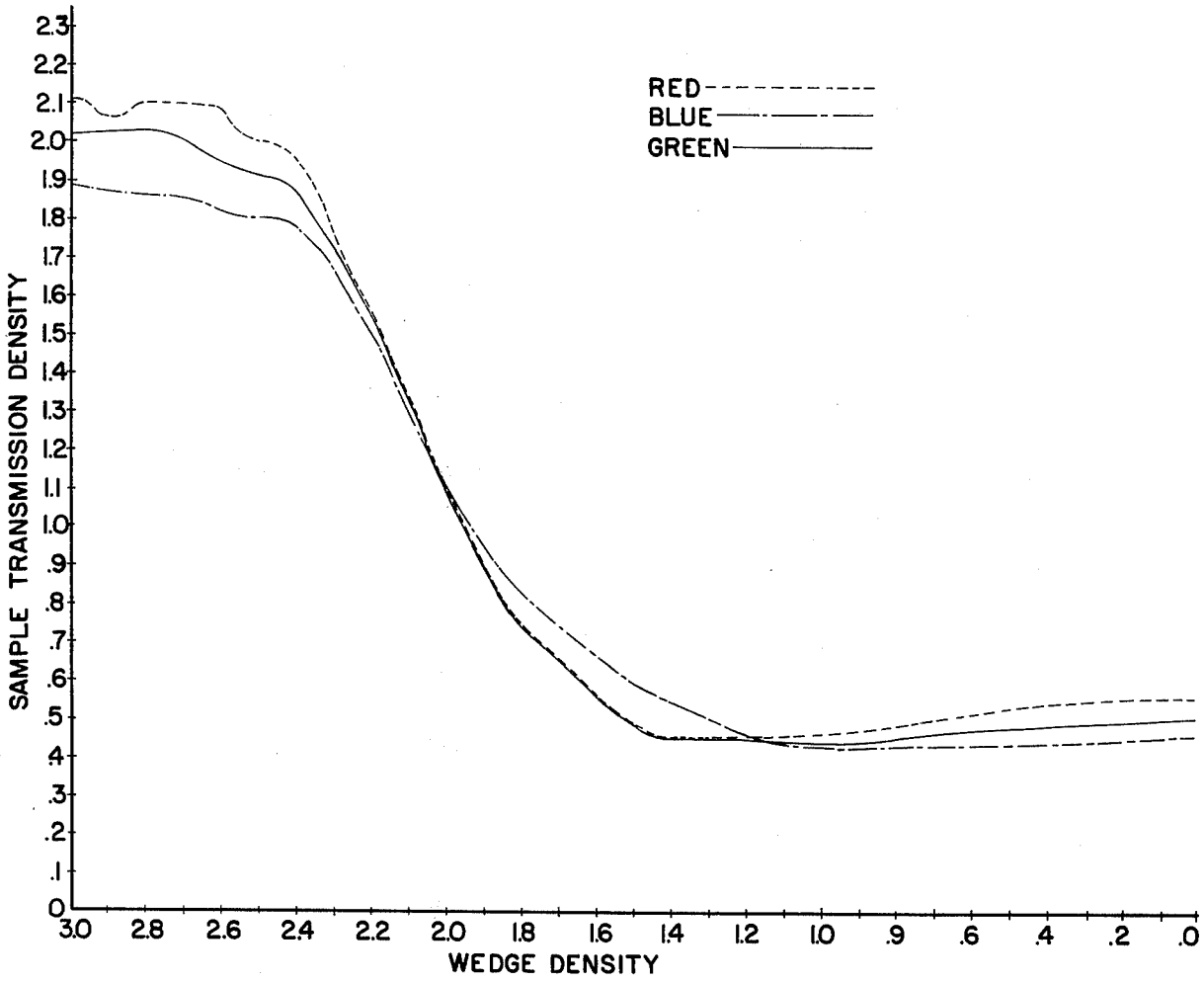
Figure 2:
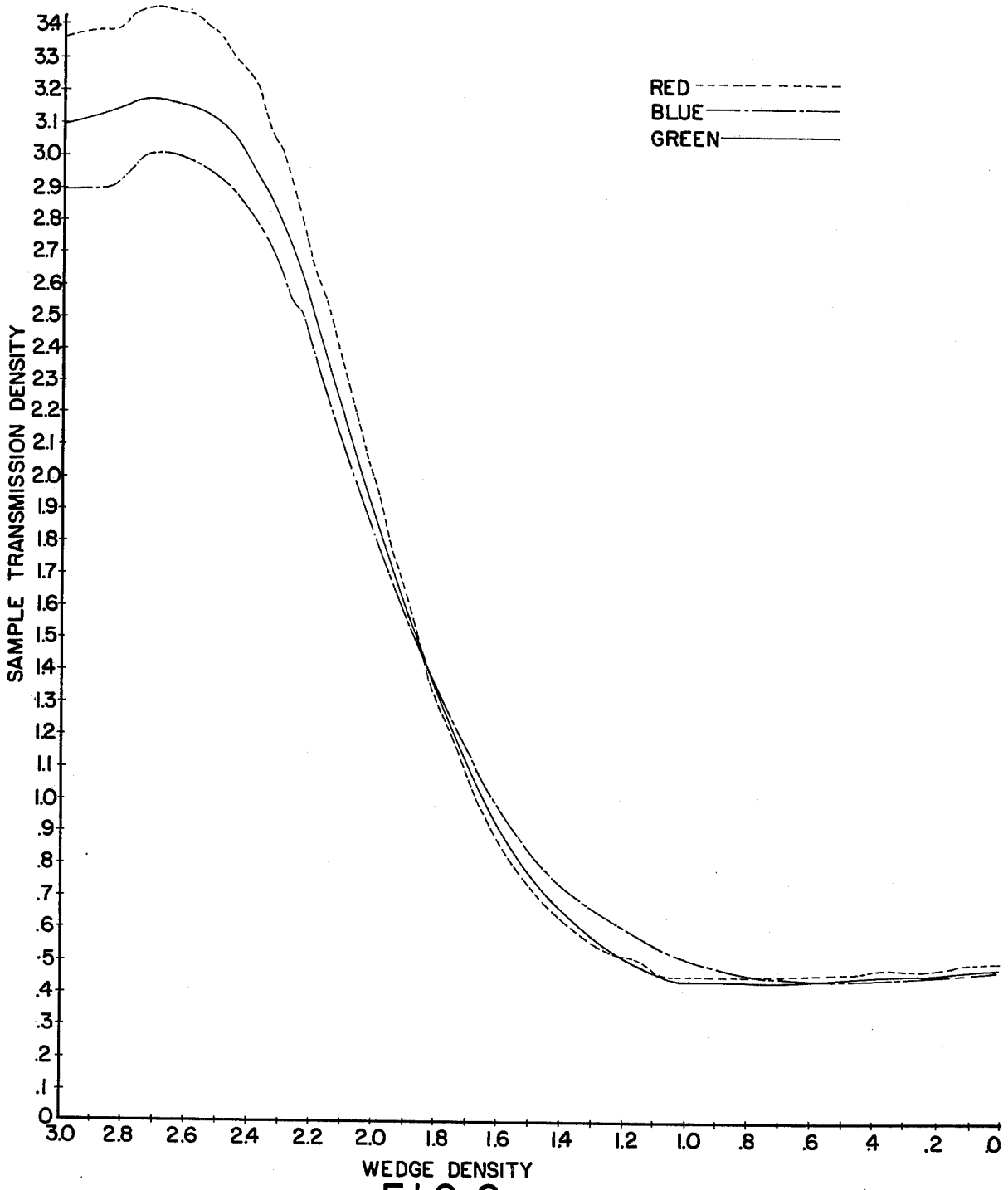

A comparison of the densitometer readings of Examples 2 and 3 illustrate the superior results achieved by employing a copper/chitin interlayer as opposed to a chitin layer alone. The differences between the two film units are graphically illustrated in FIGS. 2 and 3 which correspond to Examples 2 and 3, respectively.

EXAMPLE 4

No chitin

A film unit was prepared and processed according to the procedure of Example 2 except that gelatin was substituted for chitin in the interlayer to ascertain the effect of the binder. The following densitometer readings were obtained.

| Red | $D_{max}/D_{min}$ Green | Blue |
|---|---|---|
| 2.45/0.31 | 2.40/0.34 | 2.34/0.31 |

From the foregoing it will be noted that the combination of copper and chitin provides the unexpected superior results, which are not obtainable with the separate components.

The specific coverage of the copper/chitin layer is not critical. While the preferred coverage is set forth in Example 2, the coverage may vary over a relatively wide range. The following examples illustrate the utility of the copper/chitin layer at various coverages

EXAMPLE 5

A film unit was prepared and processed according to the procedure of Example 1 with the following composition of the copper/chitin layer.

| | mgs/ft$^2$ |
|---|---|
| Chitin | 5.6 |
| Copper Acetate Monohydrate | 1.16 (0.37 $Cu^{+2}$) |
| Acetic Acid | 4.4 |
| Alkylphenoxypolyoxyethylene ethanol surfactant | 0.195 |

The following densitometer readings were obtained:

| Red | $D_{max}/D_{min}$ Green | Blue |
|---|---|---|
| 2.96/0.30 | 2.76/0.22 | 2.67/0.21 |

EXAMPLE 6

A film unit was prepared and processed according to the procedure of Example 1 with the following compositions of the copper/chitin layer.

| | mgs/ft$^2$ |
|---|---|
| Chitin | 3.7 |
| Copper Acetate Monohydrate | 1.1 (0.35 $Cu^{+2}$) |
| Acetic Acid | 2.9 |
| Alkylphenoxypolyoxyethylene ethanol surfactant | 0.195 |

The following densitometer readings were obtained:

| Red | $D_{max}/D_{min}$ Green | Blue |
|---|---|---|
| 2.78/0.29 | 2.57/0.22 | 2.46/0.18 |

EXAMPLE 7

A film unit was prepared and processed according to the procedure of Example 1 with the following composition of the copper/chitin layer.

| | mgs/ft$^2$ |
|---|---|
| Chitin | 2.2 |
| Copper Acetate Monohydrate | 0.65 (0.2 $Cu^{+2}$) |
| Acetic Acid | 1.7 |
| Alkylphenoxypolyoxyethylene ethanol surfactant | 0.195 |

The following densitometer readings were obtained:

| Red | $D_{max}/D_{min}$ Green | Blue |
|---|---|---|
| 2.92/40 | 2.64/0.36 | 2.57/0.33 |

EXAMPLE 8

A film unit was prepared and processed according to the procedure of Example 1 with the following composition of the copper/chitin layer.

| | mgs/ft$^2$ |
|---|---|
| Chitin | 1.48 |
| Copper Acetate Monohydrate | 0.43 (0.14 $Cu^{+2}$) |
| Acetic Acid | 1.16 |
| Alkylphenoxypolyoxyethylene ethanol surfactant | 0.195 |

The following densitometer readings were obtained:

| Red | $D_{max}/D_{min}$ Green | Blue |
|---|---|---|
| 2.98/0.43 | 2.78/0.40 | 2.64/0.34 |

From the above examples it will be noted that the coverage of the copper/chitin layer can vary over a relatively wide range with good densities obtainable over this range. It is preferred, however, that the ratio of about 1 to 10 copper to chitin ratio be maintained for the best results.

EXAMPLE 9

A film unit was prepared and processed according to the procedure of Example 1 with the following composition of the copper/chitin layer.

| | mgs/ft$^2$ |
|---|---|
| Chitin | 2.22 |
| Copper Acetate Monohydrate | 2.15 (0.68 $Cu^{+2}$) |
| Acetic Acid | 1.76 |
| Alkylphenoxypolyoxyethylene ethanol surfactant | 0.195 |

The following densitometer readings were obtained:

| $D_{max}/D_{min}$ | | |
|---|---|---|
| Red | Green | Blue |
| 2.66/0.35 | 2.66/2.32 | 2.62/0.30 |

A slight drop in $D_{max}$ is noted as the chitin coverage was decreased with respect to the copper.

If desired, a relatively small amount of other polymer may be employed in the copper/chitin layer in addition to the chitin.

EXAMPLE 10

Film units were prepared according to the procedure of Example 7 with the addition of the below indicated amounts of gelatin added to the copper/chitin layer detailed in Example 7.

| | $D_{max}/D_{min}$ | | |
|---|---|---|---|
| Gelatin mgs/ft² | Red | Green | Blue |
| 0.3 | 2.87/0.33 | 2.81/0.30 | 2.76/0.33 |
| 0.9 | 2.62/0.32 | 2.68/0.30 | 2.52/0.29 |
| 3.0 | 1.72/0.30 | 1.66/0.26 | 1.60/0.24 |

As the amount of gelatin increases, the densities decrease. Therefore, any gelatin added to the copper/chitin layer should be at a level less than one-half that of the chitin.

In an alternative embodiment, copper acetate was also disposed in the emulsion.

EXAMPLE 11

Film units were prepared according to the procedure of Example 8 with the omission of the potassium chromium sulfate from the emulsion and the addition of copper acetate thereto.

| Copper Acetate | $D_{max}/D_{min}$ | | |
|---|---|---|---|
| Monohydrate mgs/ft² | Red | Green | Blue |
| 1.0 | 2.94/0.35 | 3.00/0.33 | 2.70/0.36 |
| 0.1 | 2.63/0.36 | 2.78/0.32 | 2.45/0.34 |

While the densities of the film units were good, a loss of speed was noted when the copper was placed in the emulsion. Thus, if the only mechanism involved was the anti-foggant effect of the copper, the copper in the emulsion should have provided the same results as the copper in the copper/chitin layer. As Example 12 shows, it does not.

EXAMPLE 12

A film unit was prepared and processed according to the procedure of Example 1 with the following composition of the copper/chitin layer.

| | mgs/ft² |
|---|---|
| 2-amino-2-deoxyglucose | 7.4 |
| Copper Acetate Monohydrate | 2.2 (0.70 $Cu^{+2}$) |
| Acetic Acid | 5.8 |
| Alkylphenoxypolyoxyethylene ethanol surfactant | 0.195 |

The following densitometer readings were obtained:

| $D_{max}/D_{min}$ | | |
|---|---|---|
| Red | Green | Blue |
| 3.03/0.40 | 2.88/0.35 | 2.62/0.32 |

EXAMPLE 13

A film unit was prepared and processed according to the procedure of Example 1 with the following composition of the copper/chitin layer.

| | mgs/ft² |
|---|---|
| Chitin | 2.2 |
| 2-amino-2-deoxyglucose | 5.2 |
| Copper Acetate Monohydrate | 2.2 (0.70 $Cu^{+2}$) |
| Acetic Acid | 5.8 |
| Alkylphenoxypolyoxyethylene ethanol surfactant | 0.195 |

The following densitometer readings were obtained:

| $D_{max}/D_{min}$ | | |
|---|---|---|
| Red | Green | Blue |
| 2.93/0.37 | 2.64/0.32 | 2.40/0.28 |

EXAMPLE 14

A film unit was prepared and processed according to the procedure of Example 1 except that the silver precipitating layer comprised gelatin and copper sulfide at a coverage of about 0.3 mg/ft of gelatin and 0.2 mgs/ft² of copper sulfide. The copper/chitin interlayer of Example 7 was employed.

The following densitometer readings were obtained. The film unit labeled Control was a film unit of Example 14 without the copper/chitin interlayer.

| | $D_{max}/D_{min}$ | | |
|---|---|---|---|
| | RED | GREEN | BLUE |
| CONTROL | 1.31/0.34 | 1.44/0.31 | 1.84/0.29 |
| EXAMPLE 14 | 3.16/0.32 | 3.24/0.26 | 3.03/0.30 |

It is within the scope of the present invention to employ coating aids such as sodium acetate, isopropanol and the like in the copper/chitin coating solution.

The support employed in the present invention is not critical. The support of film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol and terephthalic acid; polymeric cellulose derivatives such as cellulose acetate, triacetate, nitrate, propionate, butyrate, acetate-butyrate; or acetate propionate; polycarbonates; polystyrenes; and the like.

The additive color screen employed in the present invention may be formed by techniques well known in the art, for example, by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelengths ranges, for example, red, green, and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example, may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1958, to Edwin H. Land. While the silver halide solvent is preferably present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, for example, a pH of 12–14, is preferably imparted to the processing composition, by materials such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, for example, organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer and $\alpha$, $\beta$-enediols as disclosed in U.S. Pat. No. 3,730,716 issued to Edwin H. Land, Stanley M. Bloom and Leonard C. Farney on May 1, 1973.

What is claimed is:

1. An additive color diffusion transfer film unit which comprises a transparent support carrying, in order, an additive color screen, a layer comprising silver precipitating nuclei, a layer comprising a water soluble cupric salt and a compound selected from the group consisting of deacetylated chitin and 2-amino-2deoxyglucose and a photosensitive silver halide emulsion layer..

2. A film unit as defined in claim 1 wherein said cupric salt is copper acetate.

3. A film unit as defined in claim 1 wherein said compound ranges from about 1 to 10 mgs/ft$^2$ and said cupric ion ranges from about 0.1 to 1 mgs/ft$^2$.

4. A film unit as defined in claim 3 wherein said cupric ion is present at a level of about 0.7 mgs/ft$^2$ and said compound is present at a level of about 7 mgs/ft$^2$.

5. A film unit as defined in claim 1 wherein said layer comprising said cupric salt and said compound also contains a wetting agent.

6. A film unit as defined in claim 1 wherein said compound is deacetylated chitin.

7. A film unit as defined in claim 1 wherein said compound is 2-amino-2-deoxyglucose.

8. A film unit as defined in claim 1 wherein said layer comprising said cupric salt and said compound also includes at least a second polymer in an amount less than one half that of said compound.

9. A film unit as defined in claim 8 wherein said second polymer is gelatin.

10. A film unit as defined in claim 1 which includes an antihalation layer on the side of the silver halide emulsion layer distal to said additive screen.

11. A film unit as defined in claim 10 wherein the visible radiation absorption capacity of said antihalation layer is adapted to be discharged in situ.

12. A film unit as defined in claim 1 wherein said screen is a trichromatic screen possessing red, green and blue optical filter elements.

13. A film unit as defined in claim 1 wherein said silver precipitating nuclei are noble metal nuclei.

14. A film unit as defined in claim 13 wherein said noble metal nuclei are palladium nuclei.

15. A photographic process which comprises the steps of:

a. exposing a film unit which comprises, in order, a transparent support, an additive color screen, a layer comprising silver precipitating nuclei, a layer comprising a water soluble cupric salt and a compound selected from the group consisting of deacetylated chitin and 2-amino-2-deoxyglucose, and a photosensitive silver halide emulsion layer; and b. contacting said exposed film unit with a processing composition containing a silver halide developing agent and a silver halide solvent adapted to provide a positive silver image in said layer comprising silver precipitating nuclei.

16. The process as defined in claim 15 wherein said cupric salt is copper acetate and said compound is deacetylated chitin.

17. The process as defined in claim 15 wherein said compound is 2-amino-2-deoxyglucose.

18. The process as defined in claim 15 wherein said compound ranges from about 1 to 10 mgs/ft$^2$ and said cupric ion ranges from about 0.1 to 1 mgs/ft$^2$.

19. The process as defined in claim 15 wherein said silver precipitating nuclei are palladium nuclei.

20. The process as defined in claim 15 wherein said film unit includes an antihalation layer on the side of the silver halide emulsion layer distal to said additive screen.

21. The process as defined in claim 20 wherein the visible radiation absorbing capacity of said antihalation layer is discharged upon contact with said processing composition.

22. The process as defined in claim 15 wherein the layers of said film unit are maintained together subsequent to exposure and processing.

23. An additive color diffusion transfer film unit which comprises a transparent support carrying, in order, a trichromatic additive color screen comprising red, green and blue filter elements; a layer of palladium metal silver precipitating nuclei; a layer comprising deacetylated chitin and water soluble cupric salt; a photosensitive silver halide emulsion layer and an antihalation layer containing processing composition dischargable dyes therein.

* * * * *